United States Patent [19]

McDonald

[11] 4,285,687

[45] Aug. 25, 1981

[54] MACHINE FOR FOLDING PLASTIC SHEET MATERIAL

[75] Inventor: James A. McDonald, Palos Heights, Ill.

[73] Assignee: Union Carbide Corporation, New York, N.Y.

[21] Appl. No.: 46,382

[22] Filed: Jun. 7, 1979

[51] Int. Cl.[3] ..... B65H 45/18

[52] U.S. Cl. ..... 493/444; 493/462

[58] Field of Search ..... 270/62, 67, 69, 83; 93/84 R, 84 TW; 53/118, 120; 242/55, 67.1

[56] References Cited

U.S. PATENT DOCUMENTS

| | | | |
|---|---|---|---|
| 2,877,612 | 3/1959 | Berney | 53/118 |
| 4,180,256 | 12/1979 | Coast | 270/83 |

*Primary Examiner*—Edgar S. Burr
*Assistant Examiner*—A. Heinz
*Attorney, Agent, or Firm*—John C. LeFever

[57] ABSTRACT

An improvement in a machine for folding bags wherein bags are rolled and removed from rolling cages through an opening between the rolling cages, the improvement constituting extending the moving surface within the rolling cages beyond the rolling cages and into the opening between the rolling cages.

7 Claims, 4 Drawing Figures

MACHINE FOR FOLDING PLASTIC SHEET MATERIAL

The present invention relates to a machine for folding flexible plastic sheet material, such as plastic bags, and more particularly to an improvement in folding machines of the type which winds the bag into a roll and discharges the rolled bag in a flattened state.

The present invention is specifically directed to folding machines of the type disclosed in U.S. Pat. No. 3,918,698, entitled "High Speed Machine And Method For Folding Plastic Bags and the Like" which issued on Nov. 11, 1975 in the name of John Coast, and U.S. Pat. No. 3,671,033, entitled "Machine And Method For Folding Plastic Bags and the Like" which issued on June 20, 1972, also in the name of John Coast.

The above patents, the disclosures of which are herein incorporated by reference, each disclose the use of a rolling section which forms a curved moving surface disposed a minimum of 270° of a circle for winding the material into a roll. The rolling section is divided into at least two laterally separated sub-sections which are spaced apart to form an open unobstructed area therebetween for removing the rolled bag. Each sub-section is formed from a set of horizontally disposed parallel drive rollers whose axes are disposed a minimum of 270° of a circle to present on their inward side and within each sub-section a moving surface throughout at least a substantial portion of the 270 degrees of a circle for driving the material into a roll. The rollers are arranged to form, in effect, a cul-de-sac having an entrance opening adapted for receiving the material. After the bag is rolled it is removed through the open area between the laterally spaced sub-sections.

It has been found that the removal of the bag through the opening between the sub-sections must be carefully controlled to avoid wrinkling or creasing of the plastic sheet material. This is due to the fact that the rolled bag is processed into a flat geometry from a tubular geometry in conjunction with its removal from the rolling section in a flattened state. During this removal operation, the bag is susceptible to wrinkling, particularly at high folding speeds. High folding speeds are, however, desirable from a production standpoint.

The above described deficiencies were substantially eliminated by the development disclosed in U.S. Pat. No. 4,180,256 issued Dec. 25, 1979 in the name of John B. Coast, and which is assigned to a common assignee. According to the development disclosed therein, it was found that improved folding can be achieved by providing an enlarged area for the withdrawal of each bag and by withdrawing each bag from the rolling section over a flat surface in a direction substantially transverse to the direction of entry. Withdrawal of the bag is facilitated by drawing the bag over a planar surface coextensive with the entrance opening, and preferably having a leveled geometry formed at the end of each sub-section adjacent the opposite sides of the open area between the sub-sections. The preferred arrangement disclosed therein is to support the drive rollers in each sub-section between end plates with the corresponding end plates on opposite sides of the open area having an aperture of predetermined configuration for providing the enlarged area for withdrawal of the rolled bag.

Although the invention described in the foregoing co-pending application substantially eliminates some of the problems incident to prior art devices, nevertheless it was found that at high rates of rolling speed, i.e., about 340 to 350 feet per minute, the unsupported center section of the bag between the rolling cages "ballooned" out as a result of the centrifugal force developed by the high rolling speed. When flattened and folded after the high speed rolling, the flat width of the folded bag was out of specification.

Attempts to reduce the "ballooning" effect by decreasing the space between the rolling cages were not satisfactory since the decreased space produced an unacceptable crease in the folded bag.

Accordingly, it is the principal object of the present invention to provide an improved folding machine for folding bags by rolling each bag into a roll and withdrawing each rolled bag in a flattened state at a relatively high speed without introducing objectional wrinkles.

Another object of the present invention is to extend the moving surface into the space between the rolling sections to minimize the effect of the centrifugal force on the unsupported rolled bag and thereby control the width of the U-folded bag.

A further object is to extend rollers in cantilever support fashion into the space between the rolling sections to support the rolled bag to minimize centrifugal "ballooning".

Other objects and advantages of the present invention will become apparent from the following detailed description of the invention when read in conjunction with the accompanying drawing in which.

In accordance with the present invention there is provided an improvement in a machine for folding flexible sheet material, such as plastic bags, having rolling means for rolling the material into a roll and means for removing the rolled material from said rolling means in a flattened state, and wherein said rolling means comprises a rolling section divided into at least two laterally disposed rolling sub-sections spaced apart so as to provide a predetermined unobstructed open area therebetween, each of said rolling sub-sections being arranged in an arc circumscribing a minimum of 270° of a circle for forming a cul-de-sac having an internal moving curved surface on its inward side through a substantial portion of said 270° for driving the material into a roll, each of said sub-sections having inner and outer end plates confining the internal moving surface of each sub-section, said inner end plates on opposite sides of said open area each having an aperture in alignment with said cul-de-sac and a predetermined geometry partially conforming to the shape of said cul-de-sac, with each sub-section having an entrance opening for receiving said material, said means for removing the rolled material being arranged relative to said open area to establish a discharge path through said open area in a predetermined direction normal to the longitudinal axis of said rolled material, said improvement comprising extending a portion of the internal moving surface of each sub-section beyond said inner end plates into said unobstructed open area between said sub-sections.

FIGS. 1–4 inclusive illustrate the improved folding machine of the present invention in which plastic bags are individually wound into a roll of tubular geometry and flat folded. It should be understood that the bags can be fabricated from any suitable polymeric material using conventional techniques for the bag making operation. The preferred bag is the "U" folded side seam welded bag having a seamless bottom. Although the folding machine of the present invention is intended primarily for folding bags it is equally applicable for folding sheet goods of similar flexible material.

Figure 1:
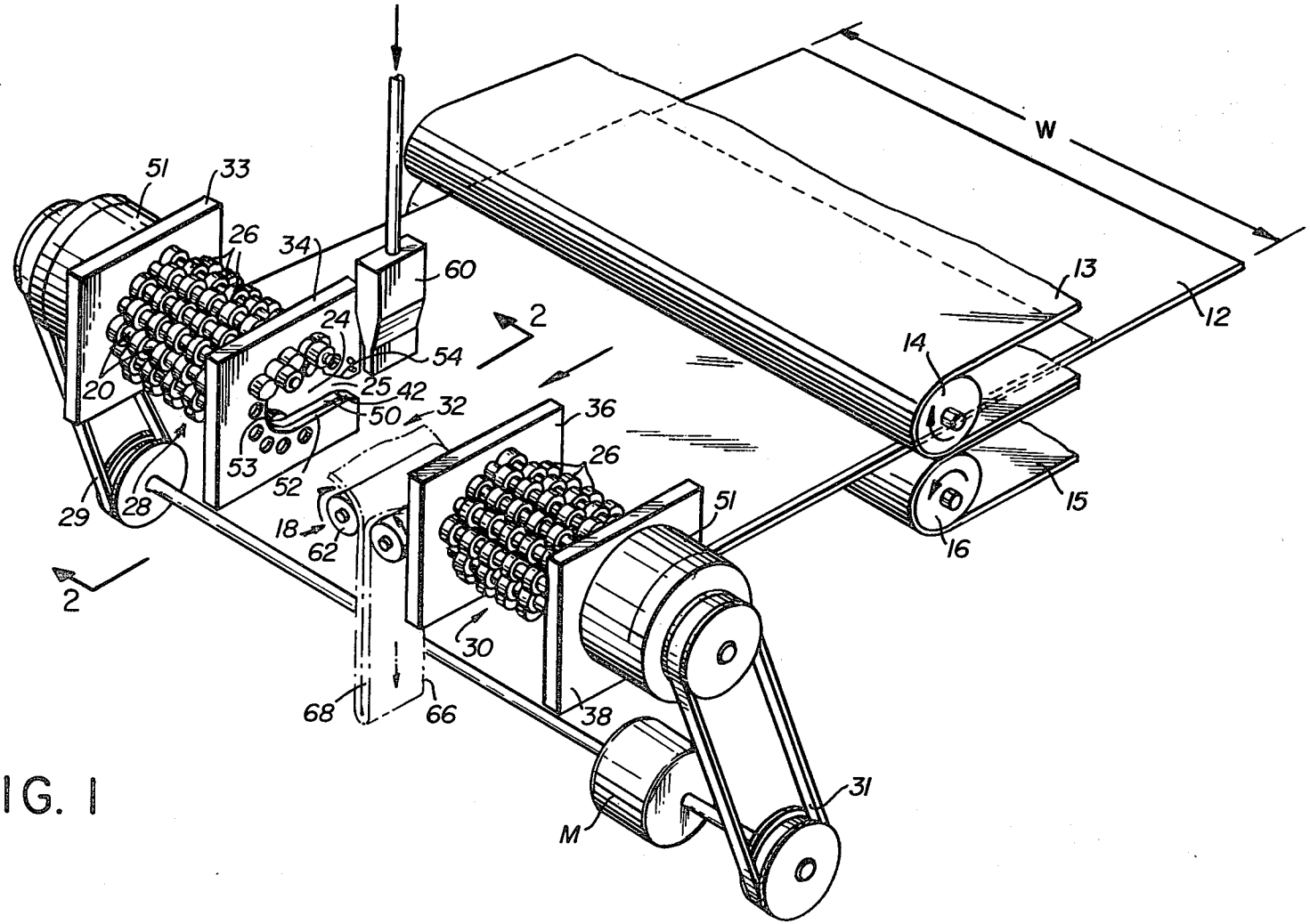
FIG. 1 is a perspective view of the folding machine of the present invention.

As schematically illustrated in FIG. 1, a bag 12 is fed, at a predetermined speed, from a pair of endless belts 13 and 15 driven by rollers 14 and 16, into a rolling section 18 of the folding machine comprised of rolling subsections 28 and 30. Although the endless belts 13 and 15 have been shown in FIG. 1 spaced a relatively substantial distance from the rolling section 18, it is preferred that they be positioned as close as possible to the entrance of the rolling section. The bag 12 may have already been prefolded any number of times to establish a predetermined width W preferably as taught in U.S. Pat. No. 4,151,787 issued May 1, 1979, entitled "A Multiple Folded Plastic Bag And Method".

Figure 2:
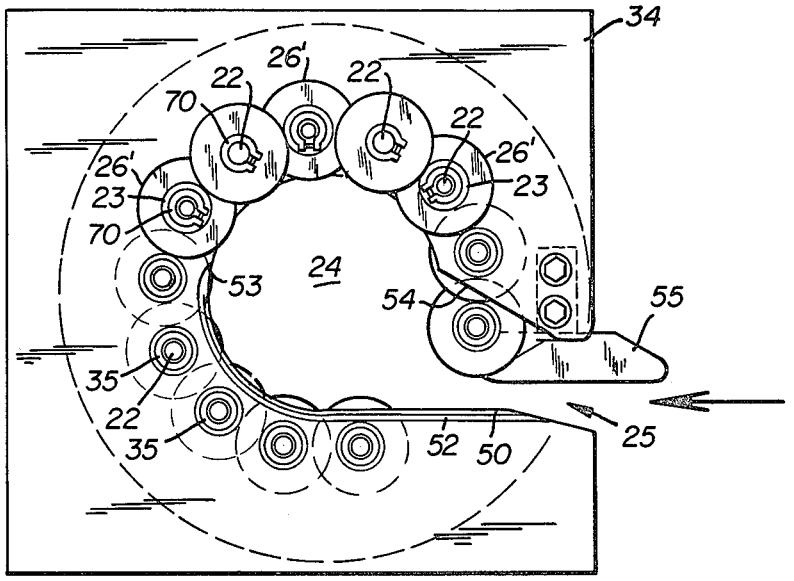
FIG. 2 is a view taken along the line 2—2 of FIG. 1.
Figure 4:
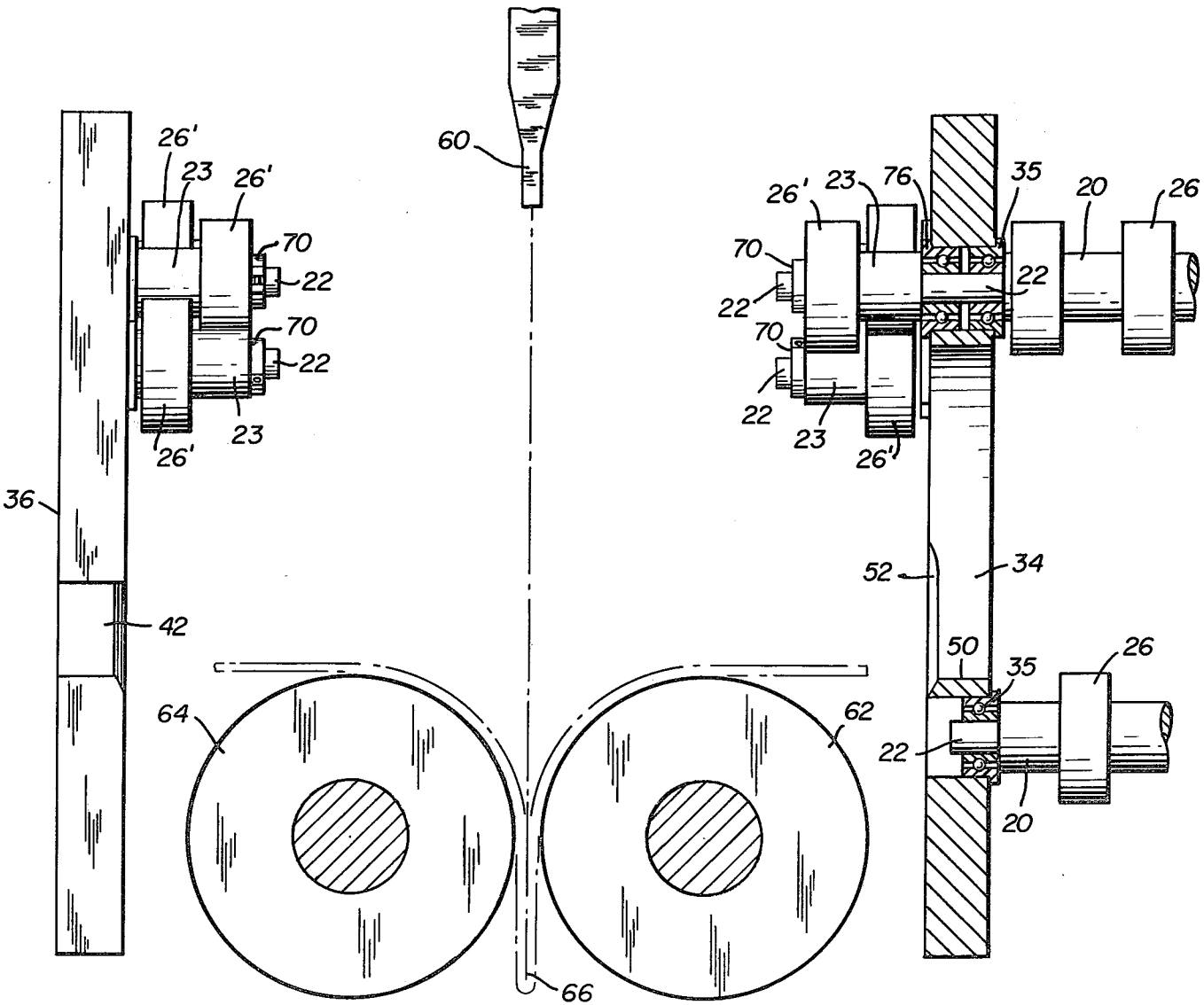
FIG. 4 is a partial elevation view of FIG. 1, looking in the direction from which the bags enter the rolling cages, with portions in section to show the modification of the construction necessary to provide the cantilevered rollers for supporting the bag during rolling to reduce the "ballooning" effect.

The rolling section 18 includes a series of drive rollers 20 mounted on shafts 22, as best seen in FIGS. 2 and 4, with the drive rollers having alternating protrusions 26 which interact with the bag to cause the bag to be wound into a roll. The longitudinal axes of the driver rollers 20 are disposed at least 270° of a circle to form a cul-de-sac having a partial enclosure 24 of generally cylindrical configuration with a periphery defining the inside moving surface of the protrusions 26 for driving the bag 12 around into a roll. The cul-de-sac partial enclosure 24 leaves an opening 25, as shown in FIGS. 1 and 2, representing the entrance opening to the bag rolling section 18. Driving force is transmitted to the bag by friction between the protrusions 26 of the drive rollers 20 and the bag itself.

Centrifugal force, bag material stiffness and the diameter of the bag as it is being rolled contribute to the normal force which holds the bag against the inner surface of drive rollers 20 and positively guide it to its rolled condition. Although not shown, it is within the scope of the present invention to use a rotatable spindle disposed within the cul-de-sac to assist in the rolling operation as taught in U.S. Pat. No. 4,180,256 issued on Dec. 25, 1979, and assigned to a common assignee, the disclosure of which is incorporated herein by reference.

Figure 3:
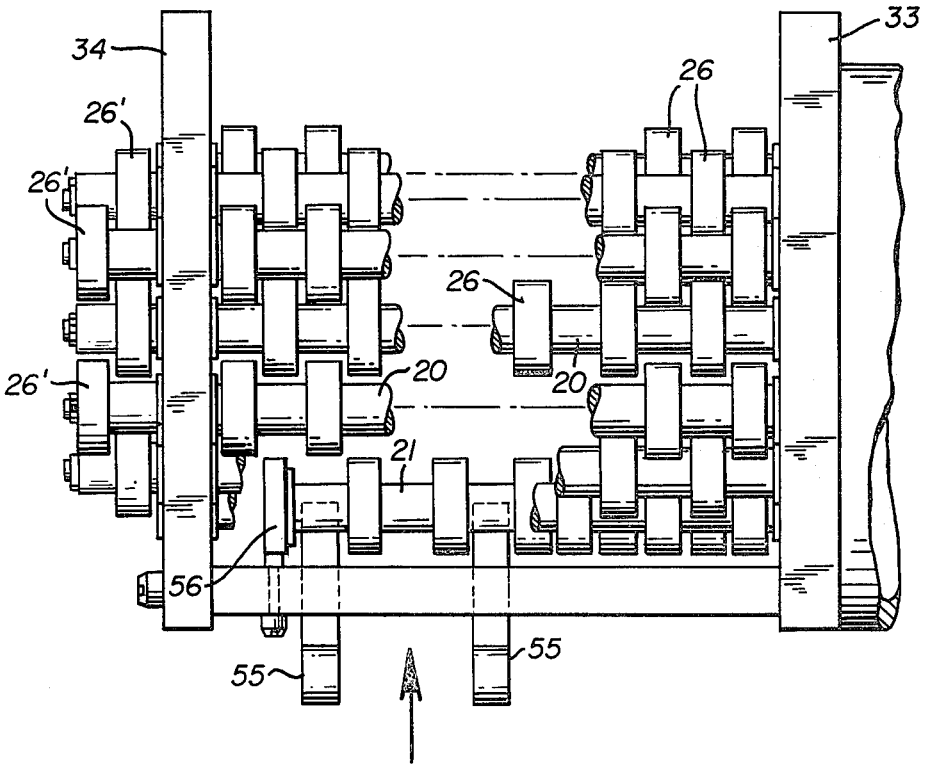
FIG. 3 is a top view of one of the rolling sub-sections of FIG. 1.

To prevent the bag from escaping between the drive rollers 20, the protrusions 26 on each drive roller 20 interdigitate with protrusions 26 on adjacent drive rollers 20, as is best shown in FIGS. 1 and 3. The drive rollers 20 are fabricated by vulcanizing an elastomeric material to shafts 22 and subsequently grooving the elastomeric material to form the protrusions 26. The grooves between protrusions 26 have a width at least about ⅛" greater than the width of the protrusions 26 of adjacent rollers and a depth that will provide clearance for the protrusions of adjacent rollers. The degree of interdigitation or intermeshing can be controlled by varying the protrusion width, diameter, or spacing and thereby the amount of overlap or intermesh. Friction characteristics of the system can of course also be varied by changing the elastomeric materials.

In order to permit the removal and flat folding of the rolled bag in the manner as hereafter explained, the rolling section 18 is centrally gapped, that is, it is divided into two preferably equal and separate sub-sections 28 and 30 respectively. The area 32 between the sub-sections 28 and 30 is thus basically an unobstructed open area. Although the sub-sections 28 and 30 are spaced from each other to establish the open area 32, they are intended to be driven from a single motor M which interconnects shafts 22 and thus drive rollers 20 of each sub-section 28 and 30 for common rotation through belts 29 and 31 and gearing assembly 51, 51. The arrangement of drive rollers 20 within each sub-section 28 and 30 is identical, thereby forming an equivalent cul-de-sac geometry within each sub-section.

The shafts 22 on which drive rollers 20 are mounted are rotatably supported in each sub-section 28 and 30 between a pair of structural end plates 33, 34 and 36, 38 respectively, with the drive rollers 20 of sub-section 28 disposed in axial alignment with the corresponding drive rollers 20 in sub-section 30. As best seen in FIGS. 2 and 4, shafts 22 disposed in the middle and the lower portion of the cul-de-sac are rotatably supported in bearings 35 in each of end plates 33, 34 and 36, 38 and do not extend beyond plates 34 and 36 into area 32. In order to minimize ballooning of the bag during rolling, a portion of the internal moving surface of each rolling section, i.e. the top portion of the cul-de-sac, is extended beyond the end plates into the space between the rolling sections. This is accomplished by extending the shafts 22 on the upper portion of the rolling section through the inner end plates 34, 36. Thus, as seen in FIGS. 2 and 4, shafts 22 on the upper portion of the rolling section are supported by bearings 35 and 76 in end plates 34 and 36 and extend beyond inner end plates 34, 36 into the space between the rolling sections. Mounted on to that portion of the shafts 22 which extend beyond end plates 34 and 36 are extended on cantilever rollers 23 with projection 26' which are fabricated from the same type of material and have generally the same configuration as drive rollers 20. Cantilever rollers 23 are detachably secured on shafts 22 by means of a central core designed to be compatible with the shaft design to permit axial motion with respect to the shaft but designed to prevent relative rotation between the core and shaft. Such designs include keyways, splines or flats on the shaft all of which expedients are well-known in the art. The cantilever rollers are "locked" axially on shafts 22 by means of TRU-ARC rings secured in a peripheral groove on said shaft or alternatively by pinning all of which expedients are well-known in the art. As shown in FIGS. 2 and 4, cantilever rollers 23 are secured axially to the shafts 22 by TRU-ARC rings 70.

The protrusions 26' on cantilever rollers 23 are positioned on shafts 22 in a manner that will permit interdigitation between adjacent cantilever rollers in a manner similar to the interdigitation of protrusions 26 on drive rollers 20.

In general, the number of cantilever rollers and number of shafts 22 extending from the end plates are limited only by the requirement of non-interference will rolled bag removal from the rolling cages. The shafts 22 and cantilevered rollers 23 can extend into the space 18 a distance so as not to interfere with the vertical operation of knife 60. Merely as illustrative, in the case where the rolling cages are spaced about 6 inches apart, the cantilever rollers 23 and shafts 22 can extend approximately 1 inch into space 18 from each end plate 34, 36.

This would leave a four inch operating clearance for knife 60 which has been found to be acceptable. On the other hand, the shafts 22 and rollers 23 cannot extend into the space 18 on the lower half of the rolling cages since such extension would interfere with the collapse of the rolled bag, thereby producing unacceptable folds or wrinkles in the bag.

From the above, it will be seen that the present invention provides a partial confining support in the space between the cages for the bag during rolling. The support is limited to a partial support since there can be no interferring obstruction introduced between the rolling cages in the path used to extract and flatten-fold the rolled bag while it is being removed from the cages. Moreover from the above, it will be seen that the unobstructed space between the cages needed for removal of the rolled bag is located between the cages on the side opposite the side from which the force is initially applied to extract the rolled bag, and the partial support is located in the space between cages on the side from where the rolled bag extracting force is first introduced.

Referring to FIGS. 1 and 4, the end plates 34 and 36 lie parallel to one another on opposite sides of the open area 32 with each having a corresponding aperture 42, 43 in alignment with and partially conforming to the shape of the cul-de-sac partial enclosure 24. The geometry of the aperture 42 of each sub-section 28 and 30 has been found to play a significant role in achieving removal of the rolled bag 12 without objectionable wrinkles.

For removal of a rolled bag it is preferred to withdraw the bag from the open area 32 in a direction substantially transverse to the direction of entry and to provide as much clearance as possible for conversion from a tubular to a flat geometry.

To achieve this, the apertures 42 in end plates 34 and 36 are designed to have a contoured geometry, including a substantially flat level bottom 50 lying substantially tangent to the moving surface of the cul-de-sac, a curved portion 53 generally conforming to the outline of the moving surface of the cul-de-sac partial enclosure 24 and terminating in an upper inclined surface 54 lying at an angle inclined with respect to the bottom surface 50, so as to provide as much room as possible for the rolled bag 12 to transform its circular shape during extraction, to an oval shape with the major axis parallel to the flat surface 50, thus minimizing wrinkling in the folded finished product. The inclined surface 54 necessitates reducing the length of one of the shafts 22 and mounted drive roller 20 in each sub-section to provide a short-roller identified as 21 in FIG. 3. The shortened drive roller 21, which is preferably shortened by eliminating one protruding portion 26, lies between the inclined surface 54 and the flat bottom surface 50. A separate mounting lug 56 is used to provide a support for rotatably supporting the shortened drive roller 21. The shortened drive roller 21 in combination with the removal of end plate material results in an inclined surface 54 which allows the circular bag to attain an oval shape when a vertical force is applied normal to the flat surface 50 of the rolled bag.

The flat bottom surface 50 of each aperture 42, 42 should have a shaped end at the juncture with the open area which is shown as beveled end 52. The beveled end 52 facilitates removal of the rolled bag from the open area 32. The bottom surface 50 provides a flat surface area over which the bag is drawn during withdrawal and also serves as an extension of the entrance opening 25 for guiding the bag 12 into the sub-sections 28 and 30 respectively. Additional guide members 55, 55 associated with each sub-section 28 and 30 guide the incoming bag into the rolling section 18.

The rolled bag 12 is withdrawn from the rolling section 18 by applying a force to the bag 12 in a preferred discharge direction with the open area 32 lying transverse to the direction in which the bag originally entered. The force is mechanically applied to the center of the bag 12, preferably by a reciprocating tucker blade 60 which extends across the width of the rolling section. This causes the bag 12 to fold over while being driven between the nip rollers 62 and 64. The nip rollers flatten the bag and establish well defined folded edges 66 and 68. Thereafter, the folded bag may be refolded any number of additional times, if so desired, and packaged.

What is claimed is:

1. An improvement in a machine for folding flexible sheet material, such as plastic bags, having rolling means for rolling the material into a substantially cylindrical roll and means for removing the rolled material from said rolling means in a flattened state, and wherein said rolling means comprises a rolling section divided into at least two laterally disposed rolling sub-sections spaced apart so as to provide a predetermined unobstructed open area therebetween, each of said rolling sub-section being arranged in an arc circumscribing a minimum of 270° of a circle for forming a cul-de-sac having an internal moving curved surface on its inward side through a substantial portion of said 270° for driving the material into a roll, each of said sub-sections having inner and outer end plates confining the internal moving surface of each sub-section, said inner end plates on opposite sides of said open area each having an aperture in alignment with said cul-de-sac and a predetermined geometry partially conforming to the shape of said cul-de-sac, with each sub-section having an entrance opening for receiving said material, each inner plate of a sub-section having first planar surfaces facing one another and bonding said open area, said means for removing the rolled material being arranged relative to said open area to establish a discharge path through said open area in a predetermined direction normal to the longitudinal axis of said rolled material, said improvement comprising an extension portion of said moving surface cantilevered from each of said inner plate first planar surfaces into said open area, means interconnecting each extension portion with its respective sub-section to permit synchronous rolling motion of each said extension portion with its respective sub-section, wherein said extension portions provide rolling auxiliary support for said plastic bags as they are being rolled into said substantially cylindrical rolls, with said extension portions being spaced-apart from one another to permit said removing means to remove a rolled bag from contact with said sub-sections and extension portions and discharge said rolled bag along said discharge path.

2. In a machine according to claim 1 wherein each of said spaced-apart rolling sub-sections comprises a series of drive rollers mounted on shafts, non-extended through said inner end plates into said open area between said sub-sections, rotatably disposed in an arrangement forming said cul-de-sac and providing said entrance opening, with the drive rollers of one sub-section being in axial alignment with the corresponding drive rollers of the other sub-section, and wherein said extension portion of the internal moving surface constitutes drive rollers mounted on shafts extended through an upper portion of said inner end plates into said open area between said sub-sections.

3. In a machine according to claim 2 wherein the length of at least one of said non-extended drive rollers and non-extended shafts in each sub-section as measured along their longitudinal axes is shorter than the length of another non-extended drive roller and non-extended shaft.

4. In a machine according to claim 2 wherein said means for removing the rolled material from said open area comprises a reciprocating tucker blade.

5. In a machine according to claim 2 wherein said extended drive rollers and extended shafts are disposed in the upper portion of said inner end plates, disposed on opposite sides of said open area, and are disposed above said end plate apertures.

6. In a machine according to claim 5 wherein said extended drive rollers are detachably secured to said extended shafts.

7. In a machine according to claim 5 or 6 wherein said extended drive rollers are mounted on said extended shafts so that said extended drive rollers on adjacent shafts interdigitate with one another.

* * * * *